US011344093B2

(12) United States Patent
Chaney

(10) Patent No.: US 11,344,093 B2
(45) Date of Patent: May 31, 2022

(54) QUICK RELEASE ASSEMBLY AND METHODS OF USING THE SAME

(71) Applicant: HSG LLC, Swansboro, NC (US)

(72) Inventor: Daniel Logan Chaney, Morehead City, NC (US)

(73) Assignee: HSG LLC, Swansboro, NC (US)

( * ) Notice: Subject to any disclaimer, the term of this patent is extended or adjusted under 35 U.S.C. 154(b) by 0 days.

(21) Appl. No.: 17/323,457

(22) Filed: May 18, 2021

(65) Prior Publication Data

US 2022/0007806 A1 Jan. 13, 2022

Related U.S. Application Data

(60) Provisional application No. 63/049,163, filed on Jul. 8, 2020.

(51) Int. Cl.

| | |
|---|---|
| ***A45C 13/02*** | (2006.01) |
| ***A45F 5/02*** | (2006.01) |
| ***A45C 11/00*** | (2006.01) |
| ***A45C 13/12*** | (2006.01) |
| ***F41C 33/04*** | (2006.01) |
| *F41H 1/02* | (2006.01) |

(52) U.S. Cl.

CPC ..... *A45C 13/02* (2013.01); *A45C 11/00* (2013.01); *A45C 13/123* (2013.01); *A45F 5/021* (2013.01); *F41C 33/04* (2013.01); *F41C 33/041* (2013.01); *A45C 2011/007* (2013.01); *A45C 2013/026* (2013.01); *F41H 1/02* (2013.01)

(58) Field of Classification Search

CPC ..... A45C 13/02; A45C 13/10; A45C 13/123; A45C 2013/026; A45C 2011/007; A45C 11/00; A45F 5/021; F41C 33/04; F41C 33/041

USPC ..... 224/235–240, 676, 681, 683, 196

See application file for complete search history.

(56) References Cited

U.S. PATENT DOCUMENTS

| | | | | |
|---|---|---|---|---|
| 4,286,741 | A * | 9/1981 | Rogers | F41C 33/0263 224/238 |
| 5,586,701 | A * | 12/1996 | Kim | F41C 33/0227 224/901.2 |
| 2004/0023574 | A1* | 2/2004 | Calkin | A62B 1/16 441/88 |
| 2007/0194073 | A1* | 8/2007 | Szabo | A45F 5/021 224/236 |
| 2012/0234878 | A1* | 9/2012 | Carter | A45C 13/30 224/101 |

(Continued)

*Primary Examiner* — Corey N Skurdal

(74) *Attorney, Agent, or Firm* — NK Patent Law

(57) ABSTRACT

Quick release assembly comprises a bag and a material organizer. The bag defines an opening flap and a fastener. The fastener includes a first fastening element provided on the opening flap and a second fastening element provided on a side wall of the bag. The second fastening element removably couples with the first fastening element. The material organizer is received within the bag and defines a pull tab that extends from the material organizer to outside of the bag. The pull tab defines an aperture sized for the first fastening element to pass therethrough for detachably coupling with the second fastening element to form a closed configuration of the bag, thereby securing the material organizer within the bag. Pulling the pull tab detaches the coupling between the first and second fastening elements.

20 Claims, 6 Drawing Sheets

(56) References Cited

U.S. PATENT DOCUMENTS

| | | | | |
|---|---|---|---|---|
| 2014/0208475 | A1* | 7/2014 | Khandelwal | A44B 11/266 2/2.5 |
| 2015/0153140 | A1* | 6/2015 | Crye | A41F 1/00 2/102 |
| 2016/0135575 | A1* | 5/2016 | Solomon | A45F 5/02 224/235 |

* cited by examiner

QUICK RELEASE ASSEMBLY AND METHODS OF USING THE SAME

CROSS-REFERENCE TO RELATED APPLICATIONS

This application claims priority to U.S. Provisional Patent Application No. 63/049,163 filed on Jul. 8, 2020, the entire contents of which are incorporated by reference herein.

TECHNICAL FIELD

The presently disclosed subject matter relates to a quick release mechanism, and specifically to a quick release assembly that provides for quick removal of an object stored within a bag.

BACKGROUND

Bags such as pouches are widely used for carrying items on a user's body and within reach of the user. Pouches are often designed for attaching to a waist belt or waistband of the user's pants or similar other clothing. Some pouches include harnesses or straps for wearing around the torso, arms, legs, ankles, or the like. In each case the pouches are typically mounted through a belt or strap passing through a closed loop. Such an arrangement necessitates two steps for retrieving an item stored within the pouch—step 1: opening the pouch, and step 2: reaching into the pouch and retrieving the item stored therein. The two-step procedure adds to the time required to retrieve an item stored within the pouch. This can result in loss of valuable time, particularly during emergency situations such as, for example, when a law enforcement officer needs to reach into a pouch to retrieve ammunition in an expedited manner in order to respond to a developing or an existing emergency situation.

It would therefore be beneficial to provide a solution that helps retrieve an item stored within a bag or pouch in an expedited manner.

SUMMARY

In order to describe the technical solutions of the examples of the present invention more clearly, the figures required to be used for the examples will be briefly introduced below. It should be understood that the following figures only show some examples of the present invention, and thus shall not be construed as limiting the scope thereof; and for a person skilled in the art, further relevant figures could also be obtained according to the figures without using inventive efforts.

In some embodiments, the presently disclosed subject matter is directed to a quick release assembly. The quick release assembly comprises a bag defining an opening flap and a fastener comprising a first fastening element provided on the opening flap and a second fastening element provided on a side wall of the bag. The second fastening element removably couples with the first fastening element to form a closed configuration of the bag. The quick release assembly further comprises a material organizer received within the bag. The material organizer defines a pull tab that extends from the material organizer to outside of the bag. The pull tab defines an aperture sized for one of the first fastening element and the second fastening element to pass therethrough for detachably coupling with the other of the first fastening element and the second fastening element in the closed configuration of the bag to thereby secure the material organizer within the bag. Pulling the pull tab when the bag is in the closed configuration operates to detach the coupling between the first fastening element and the second fastening element to form an open configuration of the bag to thereby permit removal of the material organizer from the bag.

According to one or more embodiments, a loose end of the pull tab further defines a handgrip.

According to one or more embodiments, the handgrip comprises a slot for a person's finger to engage with the slot.

According to one or more embodiments, the handgrip comprises a loop for a person's finger to engage with the loop.

According to one or more embodiments, the material organizer comprises a medical supply item.

According to one or more embodiments, the material organizer comprises a single loop.

According to one or more embodiments, the material organizer comprises one or more of a firearm holster, and a firearm supply item.

According to one or more embodiments, the fastener comprises a snap fastener, wherein the first fastening element comprises a first disc, and wherein the second fastening element comprises a second disc that interlocks with the first disc.

According to one or more embodiments, each of the first fastening element and the second fastening element comprises a magnetic material.

According to one or more embodiments, the first fastening element comprises nylon hooks, and wherein the second fastening element comprises nylon loops.

According to one or more embodiments, the first fastening element comprises a button, and wherein the second fastening element comprises an eyelet for the button to cooperate therewith.

In some embodiments, the presently disclosed subject matter is directed to a method of removing a material organizer from a bag. In at least one embodiment, the method comprises providing a bag. The bag defines an opening flap and a fastener comprising a first fastening element provided on the opening flap and a second fastening element provided on a side wall of the bag, wherein the second fastening element removably couples with the first fastening element to form a closed configuration of the bag. The method further comprises providing a material organizer. The material organizer defines a pull tab that extends from the material organizer to outside of the bag, wherein the pull tab defines an aperture sized for one of the first fastening element and the second fastening element to pass therethrough for detachably coupling with the other of the first fastening element and the second fastening element in the closed configuration of the bag to thereby secure the material organizer within the bag, wherein pulling the pull tab when the bag is in the closed configuration operates to detach the coupling between the first and second fasteners to thereby permit removal of the material organizer from the bag. The method further comprises positioning the material organizer within the bag, forming the closed configuration of the bag by removably attaching the second fastening element with the first fastening element, pulling the pull tab to detach the coupling between the first fastening element and the second fastening element, and removing the material organizer from the bag.

According to one or more embodiments, the bag further comprises a belt connection sleeve for connection to a wearer's waist belt, wherein the method further comprises looping the wearer's waist belt through the belt connection sleeve of the bag.

According to one or more embodiments, a loose end of the pull tab further defines a handgrip. According to one or more embodiments, the handgrip comprises a slot for a person's finger to engage therewith. According to one or more embodiments, the method further comprises engaging the slot with the person's finger.

According to one or more embodiments, the material organizer comprises a medical supply item, wherein the method further comprises removing the medical supply item out of the bag.

According to one or more embodiments, the material organizer comprises a firearm holster or a firearm supply item, wherein the method further comprises removing the firearm holster or the firearm supply item out of the bag.

According to one or more embodiments, the fastener comprises a snap fastener, wherein the first fastening element comprises a first disc, and wherein the second fastening element comprises a second disc that interlocks with the first disc.

According to one or more embodiments, each of the first fastening element and the second fastening element comprises a magnetic material, wherein pulling the tab operates to detach a magnetic coupling between the first fastening element and the second fastening element.

According to one or more embodiments, the first fastening element comprises nylon hooks and the second fastening element comprises nylon loops, wherein pulling the tab operates to detach a coupling between the nylon hooks and the nylon loops.

BRIEF DESCRIPTION OF THE DRAWINGS

In order to describe the technical solutions of the examples of the present invention more clearly, the figures required to be used for the examples will be briefly introduced below. It should be understood that the following figures only show some examples of the present invention, and thus shall not be construed as limiting the scope thereof; and for a person skilled in the art, further relevant figures could also be obtained according to the figures without using inventive efforts.

DETAILED DESCRIPTION OF THE EMBODIMENTS

Figure 1:
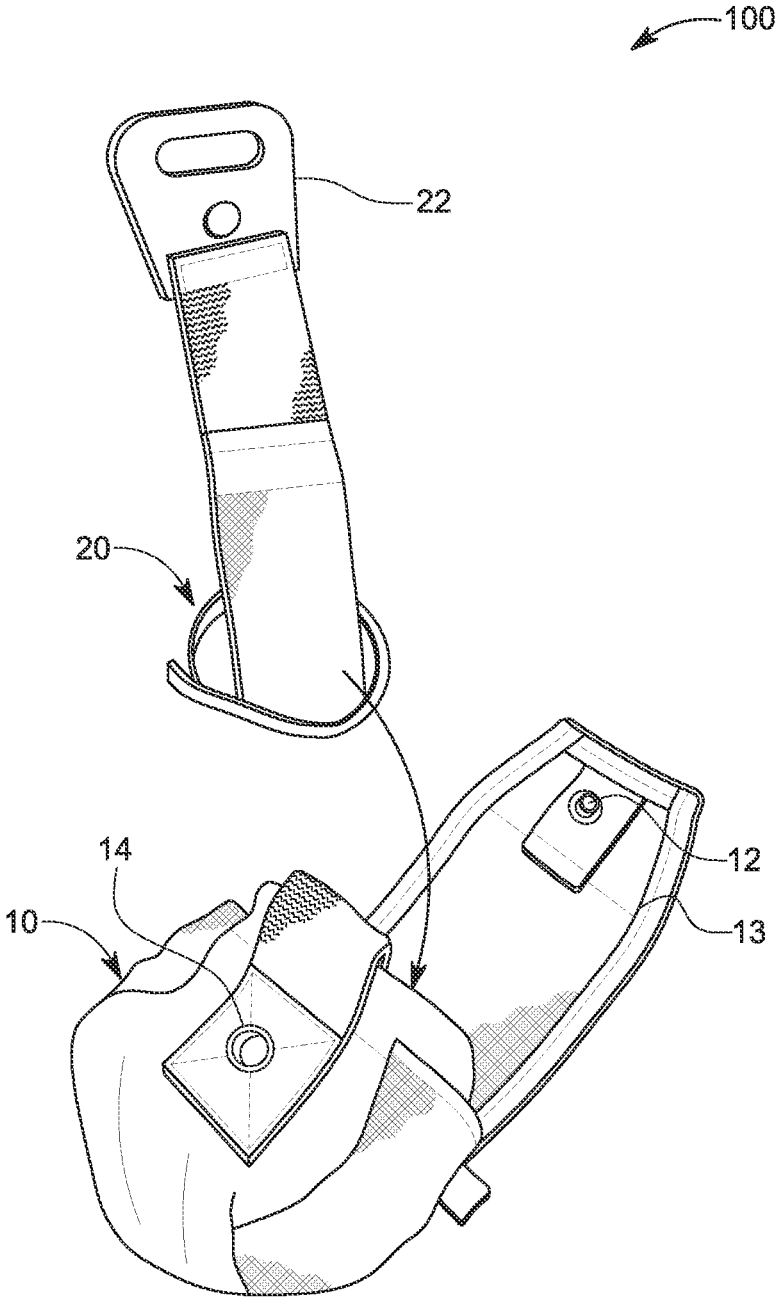
FIG. 1 is a perspective view of a quick release assembly that includes a bag in the form of pouch and a material organizer, in accordance with some embodiments of the presently disclosed subject matter.
Figure 2A:
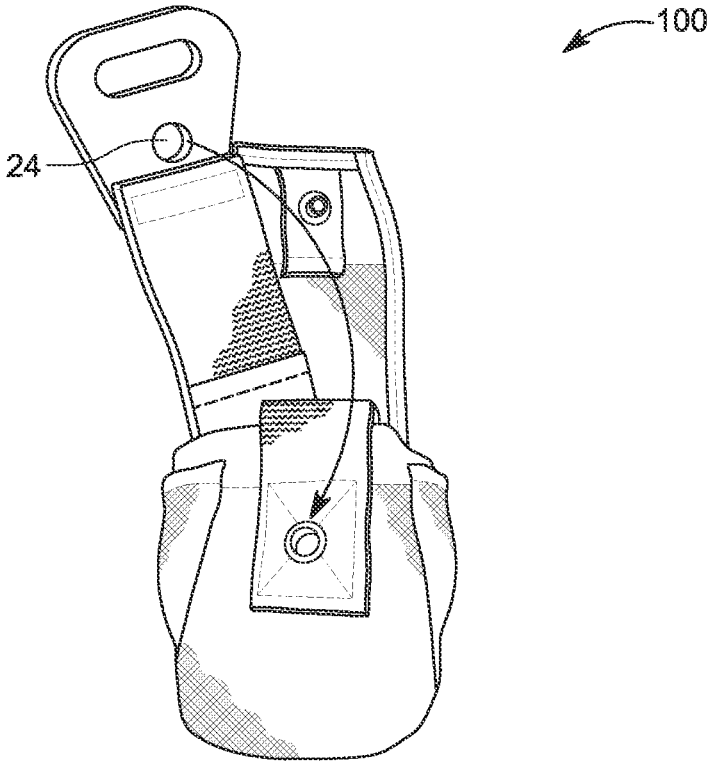
FIG. 2A is a perspective view of the quick release assembly of FIG. 1 with the material organizer positioned within the pouch with a pull tab of the material organizer shown released from a fastening element, in accordance with some embodiments of the presently disclosed subject matter.
Figure 2B:
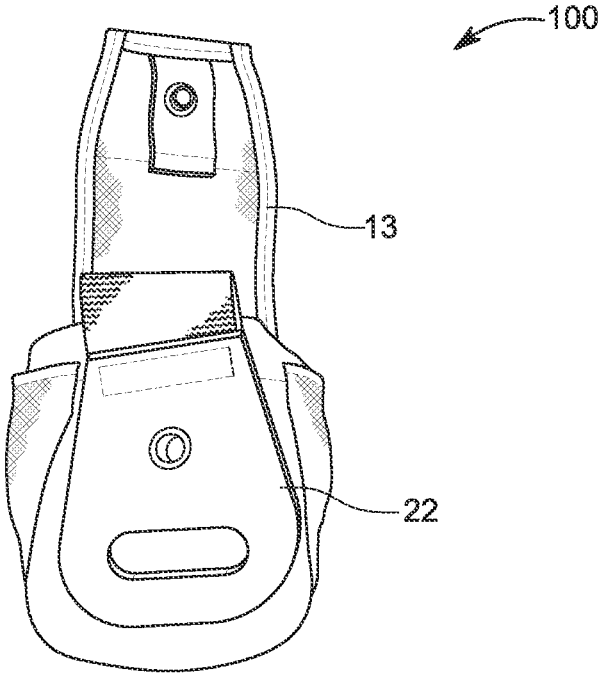
FIG. 2B is a perspective view of the quick release assembly of FIG. 1 with the material organizer positioned within the bag with the fastening element passed through an aperture of the pull tab of the material organizer, in accordance with some embodiments of the presently disclosed subject matter.
Figure 3:
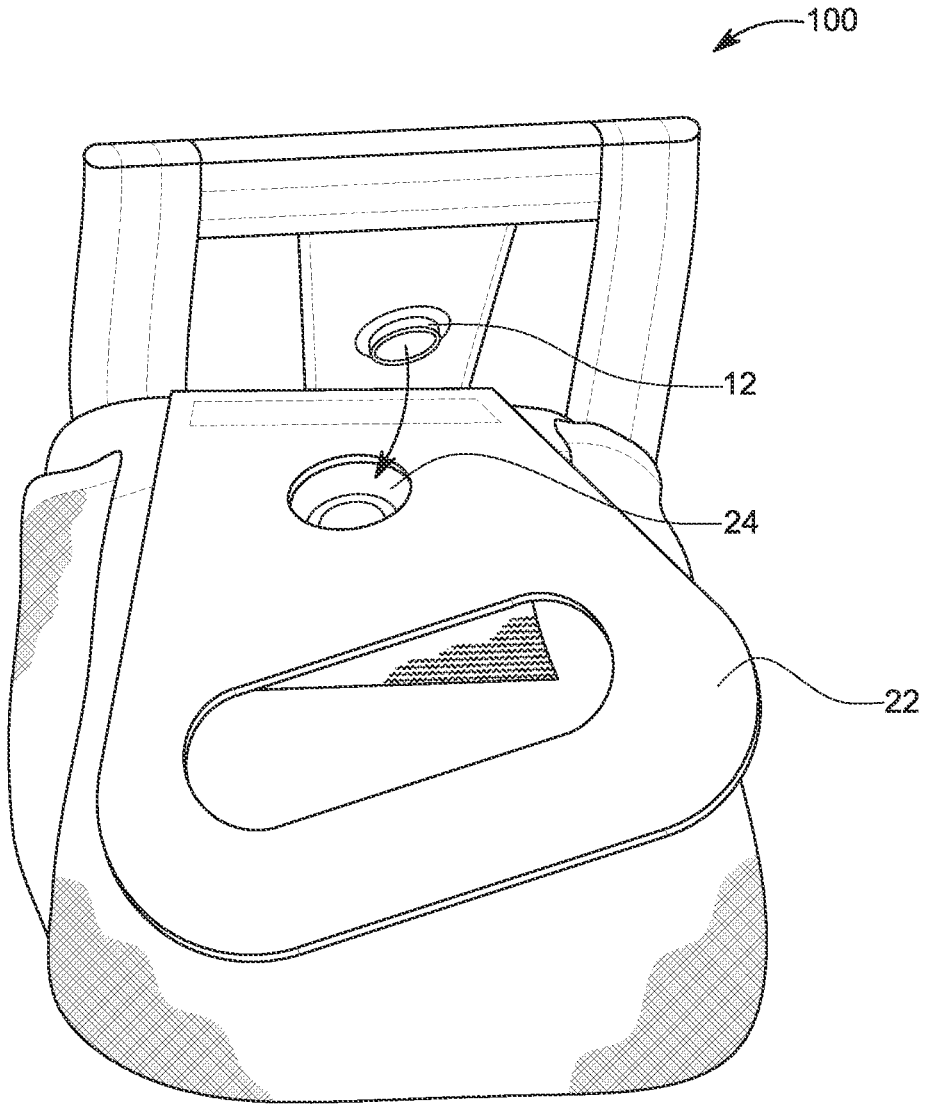
FIG. 3 is a perspective view of the quick release assembly of FIG. 1 with the bag in an open configuration with the material organizer positioned within the bag with the fastening element passed through the aperture of the pull tab of the material organizer, in accordance with some embodiments of the presently disclosed subject matter.

Below, the technical solutions in the examples of the present invention are depicted clearly and comprehensively with reference to the figures according to the examples of the present invention. Obviously, the examples depicted here are merely some examples, but not all examples of the present invention. In general, the components in the examples of the present invention depicted and shown in the figures herein can be arranged and designed according to different configurations. Thus, detailed description of the examples of the present invention provided in the figures below are not intended to limit the scope of the present invention as claimed, but merely represent selected examples of the present invention. On the basis of the examples of the present invention, all of other examples that could be obtained by a person skilled in the art without using inventive efforts will fall within the scope of protection of the present invention. The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "an object" can include a plurality of such objects, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

FIGS. 1-4 illustrate one embodiment of a quick release assembly such as quick release assembly 100 that can be used to remove an object such as a material organizer 20 stored within a closed pouch or a closed bag such as bag 10 in an expedited manner. Quick release assembly 100 accordingly also allows for the secured storage of material organizer 20 within bag 10. In various embodiments, quick release assembly 100 comprises bag 10. Bag 10 defines an opening flap 13, and a fastener 200. In various embodiments, fastener 200 comprises a first fastening element 12 provided on the opening flap 13 (or on a side wall of bag 10) and a second fastening element 14 provided on the side wall of bag 10 (or on the opening flap 13). The second fastening element 14 removably couples with the first fastening element 12 (or vice versa) to form a closed configuration of bag 10. For example, in one embodiment wherein fastener 200 is a snap-on fastener, first fastening element 12 may snap onto second fastening element 14 to form a closed configuration of bag 10. The figures illustrate bag 10 in the form of a pouch as an example, and bag 10 can take other forms such a purse, a container, a pocket, a receptacle, a wallet, a backpack, a haversack, a kit, a knapsack, a pack, a rucksack, a duffel, a carry-on, a case, a saddlebag, a tote, or other similar container that includes an opening flap, a first fastening and a second fastening element as stated herein.

Figure 4:
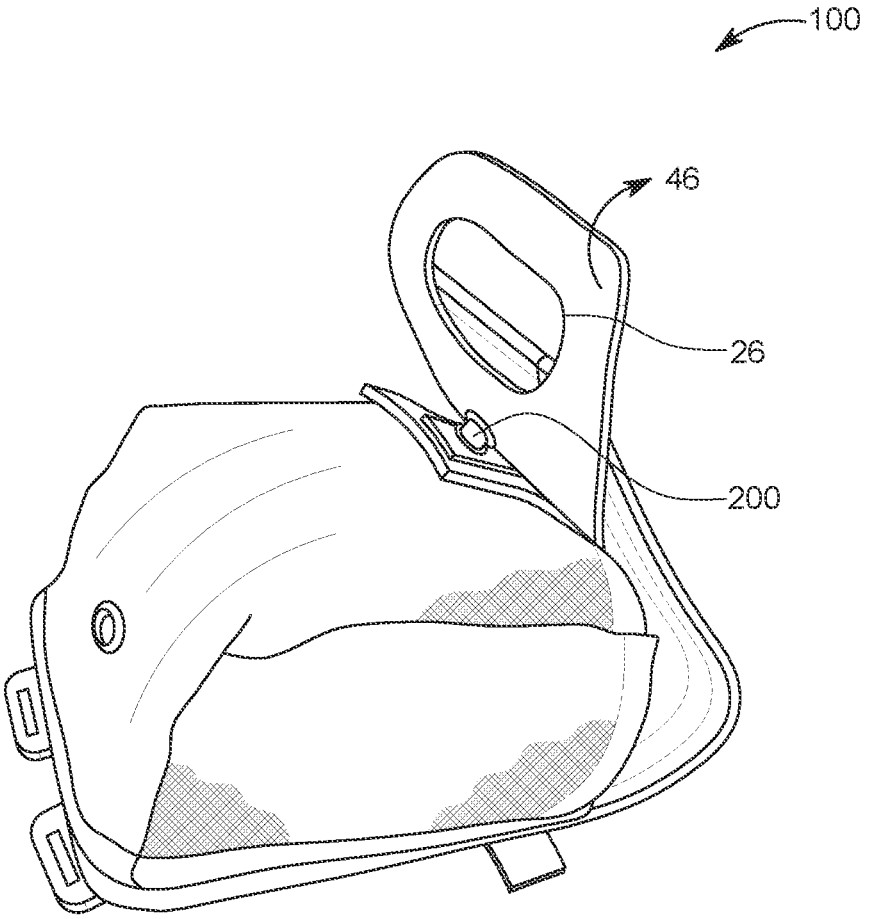
FIG. 4 is a perspective view of the quick release assembly of FIG. 1 with the bag in a closed configuration with pull tab lifted, in accordance with some embodiments of the presently disclosed subject matter.

Material organizer 20 forming part of quick release assembly 100 is configured for being received within bag 10. Material organizer 20 can accordingly be sized to fit within or otherwise be received within bag 10. In various embodiments, material organizer 20 defines a pull tab 22 that extends to an outside of bag 10 as illustrated, for example, in FIG. 2A. Pull tab 22 defines an aperture 24 sized for one of first fastening element 12 and second fastening element 14 to pass therethrough for detachably coupling with the other of first fastening element 12 and second fastening element 14 to thereby result in the closed configuration of bag 10 to secure material organizer 20 within bag 10. In at least one embodiment, when bag 10 is in the closed configuration (as shown in FIG. 4, for example), pulling pull tab 22 in direction indicated by the arrow 46 operates to detach the coupling between first fastening element 12 and second fastening element 14 to thereby result in an open configuration of the bag (as shown in FIG. 1) to permit removal of material organizer 20 from bag 10.

In various embodiments, a loose end of pull tab 22 defines a handgrip 26 configured for gripping with the fingers of a person. In at least one embodiment, as illustrated in FIG. 4, handgrip 26 can comprise a slot or opening for a person's finger to engage therewith.

Material organizer 20 can hold any item (or may itself represent any item) that can be retained within bag 10 for subsequent retrieval therefrom (i.e., from within bag 10) in a single quick action. In one embodiment, when a user desires to remove material organizer 20 from bag 10 when bag 10 is in its closed configuration, the user simply pulls pull tab 22 in the direction marked by arrow 46 in FIG. 4. Pulling of pull tab 22 results in the coupling between the first and second fastening elements to be detached and in material organizer 20 emerging out of bag 10 in a single step—without any further action required by the user.

Quick release assembly 100 can thus advantageously allow for expedited retrieval of material organizer 20 secured within bag 10 by accomplishing the retrieval in one step, rather than in two steps as is the case with existing assemblies and arrangements. As noted earlier, existing assemblies and arrangements necessitate two steps for retrieving an item stored within the bag—(1) step 1: the opening of the bag, and (2) step 2: reaching into the bag and retrieving the item stored therein. The two-step procedure increases the time required to retrieve an item stored within the bag. By contrast, material organizer 20 stored and secured within bag 10, with bag 10 being in the closed configuration, can be removed from within bag 10 by a single step of pulling pull tab 22. Pulling of pull tab 22 operates to both detach the coupling between first fastening element 12 and second fastening element 14 to form an open configuration of the bag (as shown in FIG. 1) as well as to remove material organizer 20 from within bag 10 to the outside of bag 10. The assembly as disclosed herein is accordingly quick and easy to use. In addition, it should be appreciated that the disclosed quick release assembly is relatively simple to manufacture since it includes only a few distinct parts that are used. Accordingly, there are fewer parts that can be lost compared to prior art mechanisms.

In various embodiments, material organizer 20 can contain or can represent any item that can benefit from quick removal from within a closed bag in a single step. In one embodiment, material organizer 20 may contain a medical supply such as an antidote, an allergy medication, or any other medical supply item. In one embodiment, material organizer 20 can be a firearm holster or can otherwise contain a firearm. In one embodiment, material organizer 20 can contain a firearm supply material or firearm supply item such as ammunition. According to one embodiment, an item or object can be attached to the material organizer using any known attachment mechanism, including (but not limited to) the use of one or more adhesives, mechanical closures (e.g., clips, screws, bolts, etc.), and the like.

In various embodiments, fastener 200 can take any suitable form that allows for one of first fastening element 12 and second fastening element 14 to pass through aperture 24 to detachably couple with the other of first fastening element 12 and second fastening element 14 in the closed configuration of bag 10 to thereby secure material organizer 20 within bag 10. fastener 200 can be configured such that pulling pull tab 22 when bag 10 is in the closed configuration (as shown in FIG. 4) operates to detach the coupling between first fastening element 12 and second fastening element 14 to form an open configuration of the bag (as shown in FIG. 1) to thereby permit removal of the material organizer 20 located within bag 10.

Figure 5:
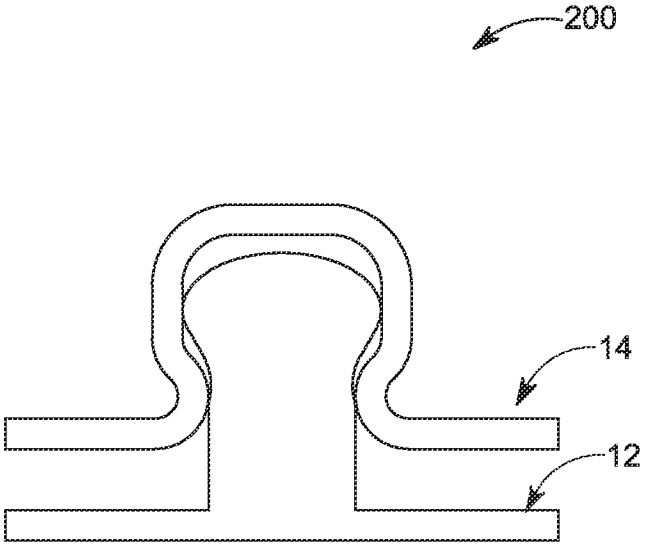
FIG. 5 is a front elevation view of a fastener including a first fastening element and a second fastening element, in accordance with some embodiments of the presently disclosed subject matter.

In at least one embodiment, the fastener comprises a snap fastener such as fastener 200 illustrated in FIG. 5. FIG. 5 illustrates front plan view of one embodiment of fastener 200 in the form of a snap fastener. As shown, first fastening element 12 and second fastening element 14 are respectively in the form of a stud and a post. Typically, to move bag 10 to a closed configuration using fastener 200, second fastening element 14 is fit over first fastening element 12 and held tightly until sufficient pressure is applied to combine them by way of snap fitting to accordingly move bag 10 to a closed configuration. If necessary, the surface of cap and socket can be customized by carving decorative patterns depending on a user's preferences.

In at least one embodiment, the fastener as mentioned herein can take the form of a snap fastener wherein the first fastening element comprises a first disc, and wherein the second fastening element comprises a second disc that interlocks with the first disc; the second disc is accordingly configured for interlocking with the first disc to removably couple therewith.

In one embodiment, the fastener can include one or more magnets. In one embodiment, the first fastening element can include a permanent magnet whereas second fastening element is formed of a ferromagnetic material or vice versa. In at least one embodiment, both the first fastening element and the second fastening element can include permanent magnets. In one embodiment, the first fastening element can include nylon hooks whereas the second fastening element comprises nylon loops such as, for example, material sold under the Velcro® commercial name. In one embodiment, the first fastening element comprises a button whereas the second fastening element comprises an eyelet for the button to cooperate therewith.

In at least one embodiment, bag 10 can further include a belt connection sleeve for connection to a wearer's waist belt.

In some embodiments, bag 10 may not include a belt connection sleeve, but instead be provided with a Modular Lightweight Load-Carrying Equipment ("MOLLE") attachment mechanism provided on a side of bag 10 that is opposite to the side where the fastener detachably attaches to the bag. As is well-known in the relevant art, MOLLE represents a military specification that defines the load-bearing design in equipment used by NATO armed forces. The universal MOLLE specification allows for small packs and bag such as bag 10 described herein to be swapped in and out as needed by a user anywhere there is an unutilized/spare grid space available on the user's gear. MOLLE thus represents a common attachment system for connecting bags, pouches, and other smaller packs. Accordingly, in at least some embodiments, bag 10 includes a MOLLE attachment mechanism provided on the back of bag 10. Such MOLLE attachment mechanism provided on bag 10 can advantageously provide for bag 10 to be attached to a MOLLE webbing or to a belt via the MOLLE attachment mechanism. In some embodiments, the MOLLE attachment mechanism can also include SlickStick® or similar other MOLLE-specific straps that are designed to weave between the attachment and bag 10. For example, the MOLLE attachment mechanism can include or can take the form of a stick or strap provided on bag 10 can be weaved through the first row of nylon webbing on the backside of the attachment.

Figure 6A:
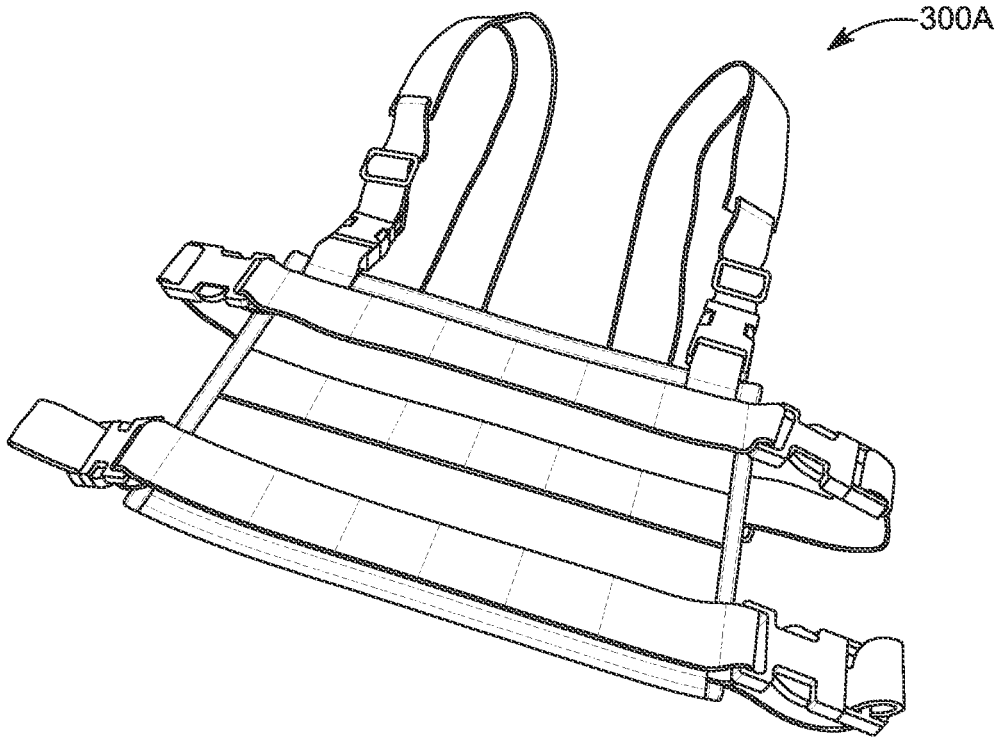
FIG. 6A is a perspective view of a first MOLLE panel that includes horizontal webbing arranged in a grid fashion to which the quick release assembly of FIG. 1 can attach thereto, in accordance with some embodiments of the presently disclosed subject matter.
Figure 6B:
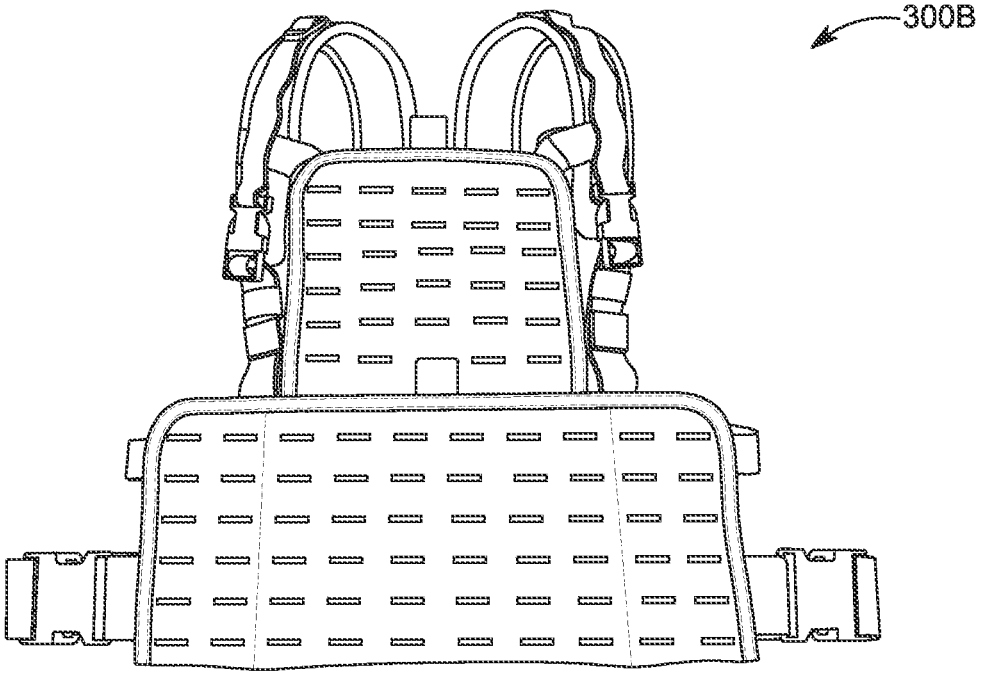
FIG. 6B is a perspective view of a second MOLLE panel that includes slits to which the quick release assembly of FIG. 1 can attach thereto, in accordance with some embodiments of the presently disclosed subject matter.

FIG. 6A illustrates a first MOLLE panel such as MOLLE 300A wherein a horizontal webbing provided therein constitutes the "MOLLE panel" arranged in a grid fashion and sewn down at regular intervals. Pouches such as bag 10 can be attached to MOLLE 300A by passing a strap or clip (i.e., as MOLLE attachment mechanism) on bag 10 through MOLLE loops provided on the MOLLE panel of MOLLE 300A. FIG. 6B illustrates a second MOLLE panel such as MOLLE 300B wherein slits are cut from a single panel using a laser or other cutting method. MOLLE 300B illustrated in FIG. 6B accordingly does not include a horizontal webbing as provided in MOLLE 300A illustrated in FIG. 6A; instead, MOLLE 300B includes slits that serve the same purpose as the horizontal webbing provided in MOLLE 300A.

Accordingly, in some embodiments, bag 10 does not include a belt pass-through feature but is instead provided with a slit or a web (i.e., a MOLLE attachment mechanism) on the back side of the bag (e.g., the side of the bag opposite the side that is exposed to the outside). A belt loop can be attached to the slit or web (i.e., the MOLLE attachment mechanism). Bag 10 in such embodiments can accordingly be attached to a MOLLE panel through a MOLLE attachment mechanism.

According to various embodiments of the presently disclosed matter, a method of removing a material organizer from a bag can include the following steps. The method includes providing a bag. The bag defines an opening flap, and a fastener comprising a first fastening element provided on the opening flap and a second fastening element provided on a side wall of the bag. The second fastening element removably couples with the first fastening element to form a closed configuration of the bag.

In some alternate embodiments, the bag may not include a flap. In such embodiments, the bag is designed such that two sides of the bag come together with their edges aligned similar to that of a tote bag with the first fastening element provided on the first side of the bag and the second fastening element provided on the second side of the bag. The second fastening element of the bag that does not include a flap removably couples with the first fastening element to form a closed configuration of the bag. Accordingly, in such embodiments, no separate opening flap is needed or provided on the bag.

The method further includes providing a material organizer. The material organizer defines a pull tab that extends from the material organizer to outside of the bag. The pull tab defines an aperture sized for one of the first fastening element and the second fastening element to pass therethrough for detachably coupling with the other of the first fastening element and the second fastening element in the closed configuration of the bag, thereby securing the material organizer within the bag. In some embodiments, two or more pairs of first and second fastening elements may be provided with a corresponding number of apertures provided for each pair of first and second fastening elements to detachably attach therethrough. Pulling the pull tab when the bag is in the closed configuration operates to detach the coupling between the first and second fasteners to thereby permit removal of the material organizer from the bag. The method further includes positioning or securing the material organizer within the bag and forming the closed configuration of the bag by removably attaching the second fastening element with the first fastening element. The method additionally includes pulling the pull tab to detach the coupling between the first and second fastening elements to permit removal of the material organizer from the bag.

In some embodiments, the method further comprises looping the wearer's waist belt through the belt connection sleeve of the bag. In some embodiments, a loose end of the pull tab further defines a handgrip. In some embodiments, the handgrip comprises a slot or loop for a person's finger to engage therewith. In some embodiments, the method further comprises engaging the slot or the loop with the person's finger. The handgrip is accordingly designed to be gripped and pulled by a person's finger(s).

In some embodiments, the material organizer comprises a medical supply, and in such embodiments the method further comprises removing the medical supply out of the bag. In some embodiments, the material organizer comprises a firearm holster or a firearm supply material, and in such embodiments the method further comprises removing the firearm holster or the firearm supply material out of the bag.

In various embodiments, the material organizer can comprise or can include a plate, a gun holster, a knife, a tool, a device, etc.

In some embodiments, the fastener comprises a snap fastener, wherein the method further comprises snapping a first fastening element in the form of a first disc onto a second fastening element in the form of a second disc to thereby cause the second disc to interlock with the first disc.

In some embodiments, each of the first and second magnetic elements comprises magnetic materials, wherein the method further comprises pulling the tab to detach a magnetic coupling between the first and second magnetic elements.

In some embodiments, the first fastening element comprises nylon hooks and the second fastening element comprises nylon loops, wherein the method further comprises pulling the tab operates to detach a coupling between the nylon hooks and the nylon loops. In various embodiments, the fastener can be based on any known attachment mechanism, including (but not limited to) the use of one or more adhesives, mechanical closures (e.g., clips), and the like.

Fastener 200 can be constructed from any desired rigid material, including (but not limited to) metal, plastic, wood, and the like. Bag 10 can be constructed from any desired flexible material or rigid material as required by the application at hand. The term "rigid" as used herein refers to material that is substantially non-pliable and retains its shape when subjected to stress. Suitable rigid materials can include, but are not limited to, metal (e.g., stainless steel, aluminum, galvanized metal), plastic (polyethylene, PVC), wood, or combinations thereof. In at least one embodiment, the bag as mentioned herein takes the form of a pouch.

Handgrip 26 and/or pull tab 22 allows a user to easily detach the coupling between the first and second fastening elements to thereby permit removal of the material organizer from the bag. For example, handgrip 26 and/or pull tab 22 can include one or more raised ridges, rubber grips, textured regions, and the like. In one embodiment, handgrip 26 and/or pull tab 22 can represent a piece of webbing or cord. In some embodiments, aperture 24 can be configured in a rectangular shape, although any desired shape can be used.

It should be appreciated that the quick release assembly, the bag, and the material organizer can be configured in any desired size, depending on the size of the item to be moved. For example, when the material organizer is used as a gun holster, the assembly can have a length and/or height of about 3-6 inches (e.g., 3, 3.25, 3.5, 3.75, 4, 4.25, 4.5, 4.75, 5, 5.25, 5.5, 5.75, or 6 inches). However, the presently disclosed subject matter is not limited and can be configured to be larger or smaller than the range given above.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated.

These and other changes can be made to the disclosure in light of the Detailed Description. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

What is claimed is:

1. A quick release assembly comprising:

a bag defining:

an opening flap; and a fastener comprising a first fastening element provided on the opening flap and a second fastening element provided on a side wall of the bag, wherein the second fastening element removably couples with the first fastening element to form a closed configuration of the bag;

a material organizer received within the bag, wherein the material organizer defines a pull tab that extends from the material organizer to outside of the bag, wherein the pull tab defines an aperture sized for one of the first fastening element and the second fastening element to pass therethrough for detachably coupling with the other of the first fastening element and the second fastening element in the closed configuration of the bag to thereby secure the material organizer within the bag, wherein pulling the pull tab when the bag is in the closed configuration operates to detach the coupling between the first fastening element and the second fastening element to form an open configuration of the bag to thereby permit removal of the material organizer from the bag.

2. The assembly of claim 1, wherein a loose end of the pull tab further defines a handgrip.

3. The assembly of claim 2, wherein the handgrip comprises a slot for a person's finger to engage with the slot.

4. The assembly of claim 2, wherein the handgrip comprises a loop for a person's finger to engage with the loop.

5. The assembly of claim 1, wherein the material organizer comprises a single loop.

6. The assembly of claim 1, wherein the material organizer comprises one or more of a firearm holster, and a firearm supply item.

7. The assembly of claim 1, wherein the fastener comprises a snap fastener, wherein the first fastening element comprises a first disc, and wherein the second fastening element comprises a second disc that interlocks with the first disc.

8. The assembly of claim 1, wherein each of the first fastening element and the second fastening element comprises a magnetic material.

9. The assembly of claim 1, wherein the first fastening element comprises nylon hooks, and wherein the second fastening element comprises nylon loops.

10. The assembly of claim 1, wherein the first fastening element comprises a button, and wherein the second fastening element comprises an eyelet for the button to cooperate therewith.

11. A method of removing a material organizer from a bag, the method comprising:

providing a bag, wherein the bag defines:

an opening flap; and a fastener comprising a first fastening element provided on the opening flap and a second fastening element provided on a side wall of the bag, wherein the second fastening element removably couples with the first fastening element to form a closed configuration of the bag;

providing a material organizer, wherein the material organizer defines:

a pull tab that extends from the material organizer to outside of the bag, wherein the pull tab defines an aperture sized for one of the first fastening element and the second fastening element to pass therethrough for detachably coupling with the other of the first fastening element and the second fastening element in the closed configuration of the bag to thereby secure the material organizer within the bag, wherein pulling the pull tab when the bag is in the closed configuration operates to detach the coupling between the first and second fasteners to thereby permit removal of the material organizer from the bag;

positioning the material organizer within the bag;

forming the closed configuration of the bag by removably attaching the second fastening element with the first fastening element;

pulling the pull tab to detach the coupling between the first fastening element and the second fastening element; and removing the material organizer from the bag.

12. The method of claim 11, wherein the bag further comprises a belt connection sleeve for connection to a wearer's waist belt, wherein the method further comprises looping the wearer's waist belt through the belt connection sleeve of the bag.

13. The method of claim 11, wherein a loose end of the pull tab further defines a handgrip.

14. The method of claim 13, wherein the handgrip comprises a slot for a person's finger to engage therewith.

15. The method of claim 14, wherein the method further comprises engaging the slot with the person's finger.

16. The method of claim 11, wherein the material organizer comprises a medical supply item, wherein the method further comprises removing the medical supply item out of the bag.

17. The method of claim 11, wherein the material organizer comprises a firearm holster or a firearm supply item, wherein the method further comprises removing the firearm holster or the firearm supply item out of the bag.

18. The method of claim 11, wherein the fastener comprises a snap fastener, wherein the first fastening element comprises a first disc, and wherein the second fastening element comprises a second disc that interlocks with the first disc.

19. The method of claim 11, wherein each of the first fastening element and the second fastening element comprises a magnetic material, wherein pulling the tab operates to detach a magnetic coupling between the first fastening element and the second fastening element.

20. The method of claim 11, wherein the first fastening element comprises nylon hooks and the second fastening element comprises nylon loops, wherein pulling the tab operates to detach a coupling between the nylon hooks and the nylon loops.

* * * * *